United States Patent [19]

Broxholm et al.

[11] 3,998,129

[45] Dec. 21, 1976

[54] MODULAR LIQUID PROPELLANT GUN

[75] Inventors: Thomas M. Broxholm, Palo Alto; Lester C. Elmore, Portola Valley, both of Calif.

[73] Assignee: Pulsepower Systems, Inc., San Carlos, Calif.

[22] Filed: Jan. 14, 1974

[21] Appl. No.: 433,200

Related U.S. Application Data

[62] Division of Ser. No. 104,610, Jan. 7, 1971, Pat. No. 3,800,657.

[52] U.S. Cl. ..... 91/39; 91/453; 137/625.66; 137/625.69

[51] Int. Cl.[2] ..... F15B 13/042; F15B 21/02

[58] Field of Search ..... 91/368, 385, 382, 453, 91/367, 427, 7, 39, 40, 219; 137/625.66, 625.69; 251/4

[56] References Cited

UNITED STATES PATENTS 2,471,688 5/1949 Holmes ..... 91/219

*Primary Examiner*—Irwin C. Cohen
*Attorney, Agent, or Firm*—Owen, Wickersham & Erickson

[57] ABSTRACT

A gun of the kind in which liquid propellant is burned in the firing chamber to fire a projectile from the gun is constructed so that a number of gun modules can be combined in a modular gun. Each gun module is cam controlled, and a common cam is used to control each gun module in the modular gun. The cam can be a flexible cam having a belt configuration to permit the gun modules to be arranged in both circular groupings and in non-circular groupings, such as side by side. The modular gun includes fixed, non-rotating gun modules to eliminate the need for tangential velocity correction factors in the fire control and the need to accelerate the mass of the barrel assembly to operational speed. The individual gun module includes propellant injection mechanism for injecting propellant at high pressure when a non-hypergolic bi-propellant is used as the propellant. One or more hydraulic actuators are used to develop the high injection pressures and to operate other components of the gun, such as the bolt. The hydraulic actuators are also engaged with the cam to interlock the actuators and the controls for the actuators through the cam. A source of pressurized hydraulic fluid independent of the gun is used to power the actuators so that the weight and profile of the gun are kept to a minimum. The hydraulic system includes a compound spool control valve which operates in a dual mode to permit normal cyclic operation of the gun during firing and to maintain the gun in an open bolt condition during armed but non-firing operations. The hydraulic system includes a misfire detection mechanism and module shutdown valve which locks a misfired gun module in the closed bolt condition without the need to depressurize the hydraulic circuits of the other gun modules and without the need to include additional bypass circuits. The injection mechanism for injecting the bi-propellant includes two pistons which are yoked together and operated by a single actuator to inject the propellant into the firing chamber both in metered amounts and in a constant mix ratio. The pistons for injecting the bi-propellant include valves in the pistons, and the pistons are drawn through the fuel on retraction strokes of the pistons. The injection mechanism is retracted away from the firing chamber after the firing of a burst to isolate the propellant in the injection mechanism from the heat of the firing chamber. A rotary lock is mounted closely adjacent the bolt mechanism and engages a relieved area of the bolt in the locked position of the lock so that a quite small force on the lock will hold the bolt mechanism locked against high combustion chamber pressures tending to open the bolt.

1 Claim, 33 Drawing Figures

MODULAR LIQUID PROPELLANT GUN

This application is a division of parent application Ser. No. 104,610 filed Jan. 7, 1971 and entitled "Modular Liquid Propellant Gun" and claims the benefit of the filing data of the parent application.

This invention relates to a gun of the kind in which liquid propellant is burned in the firing chamber to fire the projectile from the gun.

This invention relates particularly to a liquid propellant gun constructed as an individual gun module so that a number of gun modules can be combined in a modular gun.

In conventional guns powder for firing each projectile is carried in a case attached to the projectile.

A liquid propellant gun has a number of advantages over such conventional guns.

If the liquid propellant gun uses the same size projectile as a conventional gun, the projectile feed for the liquid propellant gun can be simplified and can be made considerably lighter in weight than for a conventional gun. Or, a considerably larger charge can be used for higher performance without having to increase the size of the projectile feed mechanism.

A liquid propellant gun can produce a flatter combustion chamber pressure-time characteristic than a solid propellant gun. Hence performance equivalent to a solid propellant gun can be obtained at lower pressure.

High cyclic rates of fire are possible with a liquid propellant gun.

Because the propellant is a liquid the propellant can be easily pumped to the firing chamber from a storage area remote from the gun itself. This permits flexibility of installation.

When the gun is installed in an aircraft and a non-hypergolic bi-propellant is used, one of the components of the non-hypergolic bi-propellant can be the fuel used for the engine of the aircraft.

The liquid propellant gun permits a low profile, clean exterior design so that an individual liquid propellant gun module, or a modular grouping of liquid propellant gun modules, can be installed in locations that would not accommodate a conventional gun.

It is a primary object of the present invention to incorporate these inherent advantages of a liquid propellant gun in a modular gun.

Further objects of the present invention include the specific structures and features of operation noted in the abstract above.

Other and further objects of the present invention will be apparent from the following description and claims and are illustrated in the accompanying drawings which, by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

In the drawings:

FIG. 1 shows the three main components of an individual gun module—the barrel assembly, the receiver assembly, and the control assembly;

FIG. 12 illustrates how four individual gun modules can be arranged in a circular grouping in a modular gun constructed in accordance with an embodiment of the present invention;

FIG. 13 illustrates how four individual gun modules may be arranged side by side in a modular gun constructed in accordance with an embodiment of the present invention;

FIG. 20 shows the bolt locking mechanism in the unlocked mode;

Figure 1:
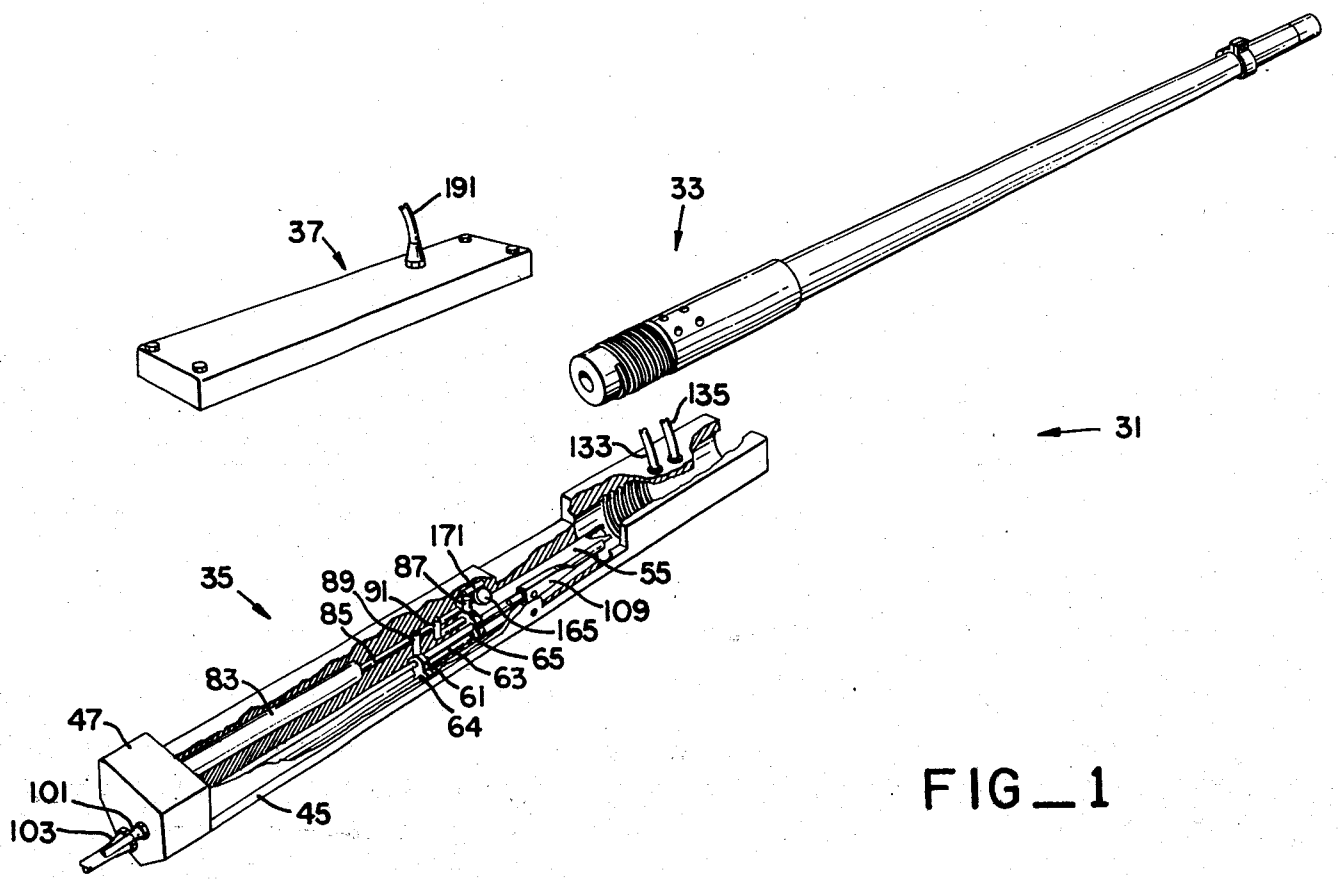
FIG. 1 is an isometric exploded view (partially broken away to show details of construction) of an individual gun module constructed in accordance with one embodiment of the present invention.

An individual gun module constructed in accordance with one embodiment of the present invention is indicated generally by the reference numeral 31 in FIG. 1.

The gun module 31 includes three main components--a barrel assembly 33, a receiver assembly 35, and a control assembly 37.

Figure 12:
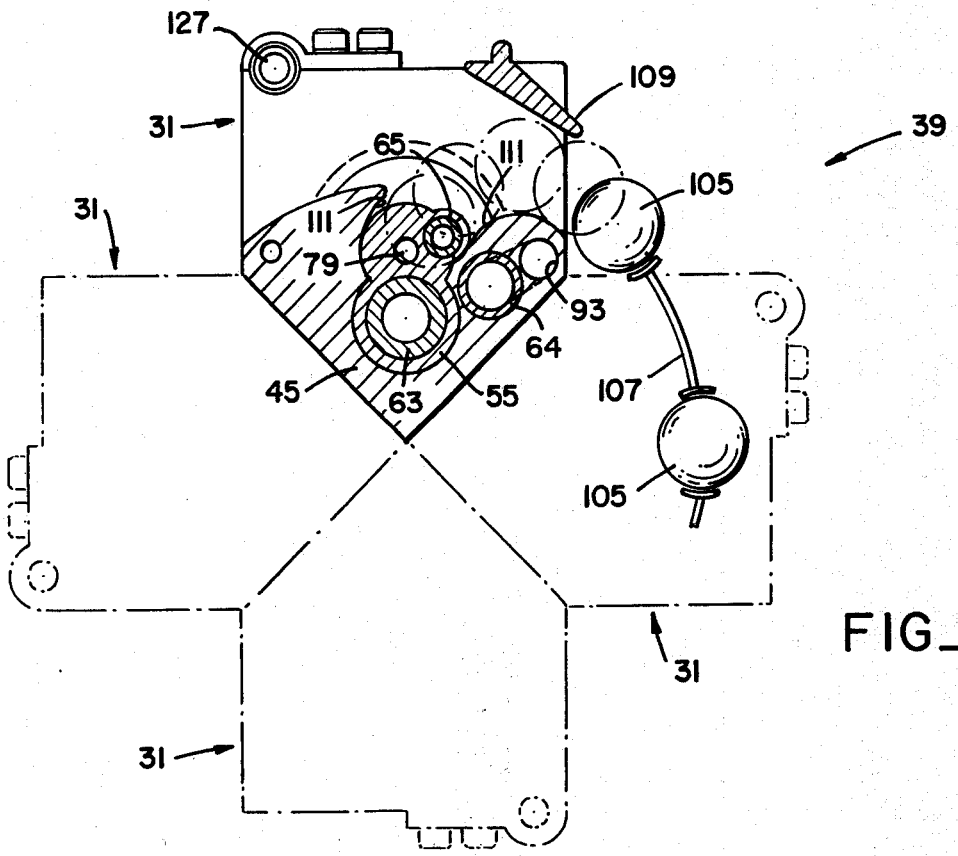
FIG. 12 is an elevation view taken along the line and in the direction indicated by the arrows 12—12 in FIG. 3A.
Figure 13:
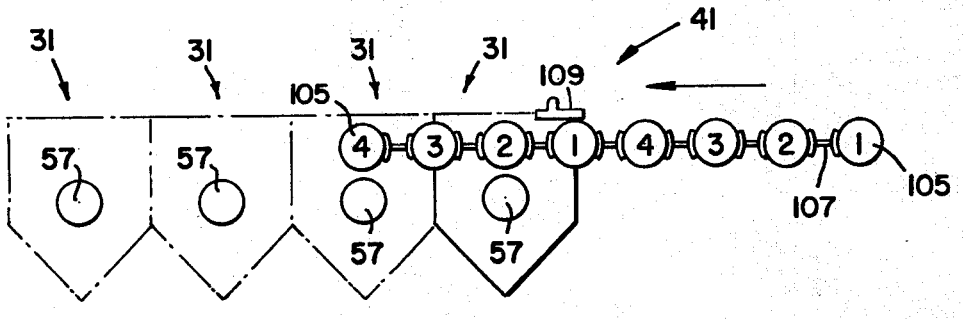
FIG. 13 is a schematic front end elevation view illustrating the way in which the projectiles are spaced at one half the pitch between adjacent gun modules.

The gun module 31 may be used by itself or (as will be described in greater detail below) may be arranged in both circular groupings (as shown in FIG. 12) or in noncircular groupings (as shown in FIG. 13) to form modular guns. The modular guns are indicated generally by reference numerals 39 and 41 in FIGS. 12 and 13.

The gun module 31 is a liquid propellant gun. The gun burns a liquid propellant in the firing chamber to propel the projectile.

The particular embodiment of the gun 31 shown in the drawings and described below is constructed to use a bi-propellant, a propellant having two components which have mixed in the firing chamber. The gun module 31 shown in FIG. 1 uses a non-hypergolic bi-propellant. The two components of the bi-propellant do not ignite on contact.

Non-hypergolic bi-propellants have this advantage over hypergolic bi-propellants. The non-hypergolic bipropellant can be handled in the same way as a mono-propellant. For example, the firing chamber can be fired, without spontaneous ignition, as in a mono-propellant. Because of this fact, the chamber can be fired without having to pump against combustion pressure; and the propellant can be loaded in an exact amount before ignition is started. It should be noted, however, that many of the principles of the present invention could be applied to liquid propellant guns using hypergolic bi-propellants. Most of the principles of the present invention can be applied to liquid propellant guns using mono-propellants.

The bi-propellant is ignited in the combustion chamber by a spark plug in the embodiment of the gun module shown in FIG. 1. Ignition can also be accomplished by compression ignition or by injecting a chemical into the propellant. The present invention is not restricted to spark ignition.

The gun module 31 is a cam-controlled, hydraulically powered gun. The main cam maintains a proper sequence and timing relationship between the various components of the gun while hydraulic power is the primary energy source.

The cam for controlling the gum module 31 is shown in FIGS. 15, 16, 18 and 19.

Figure 14A:
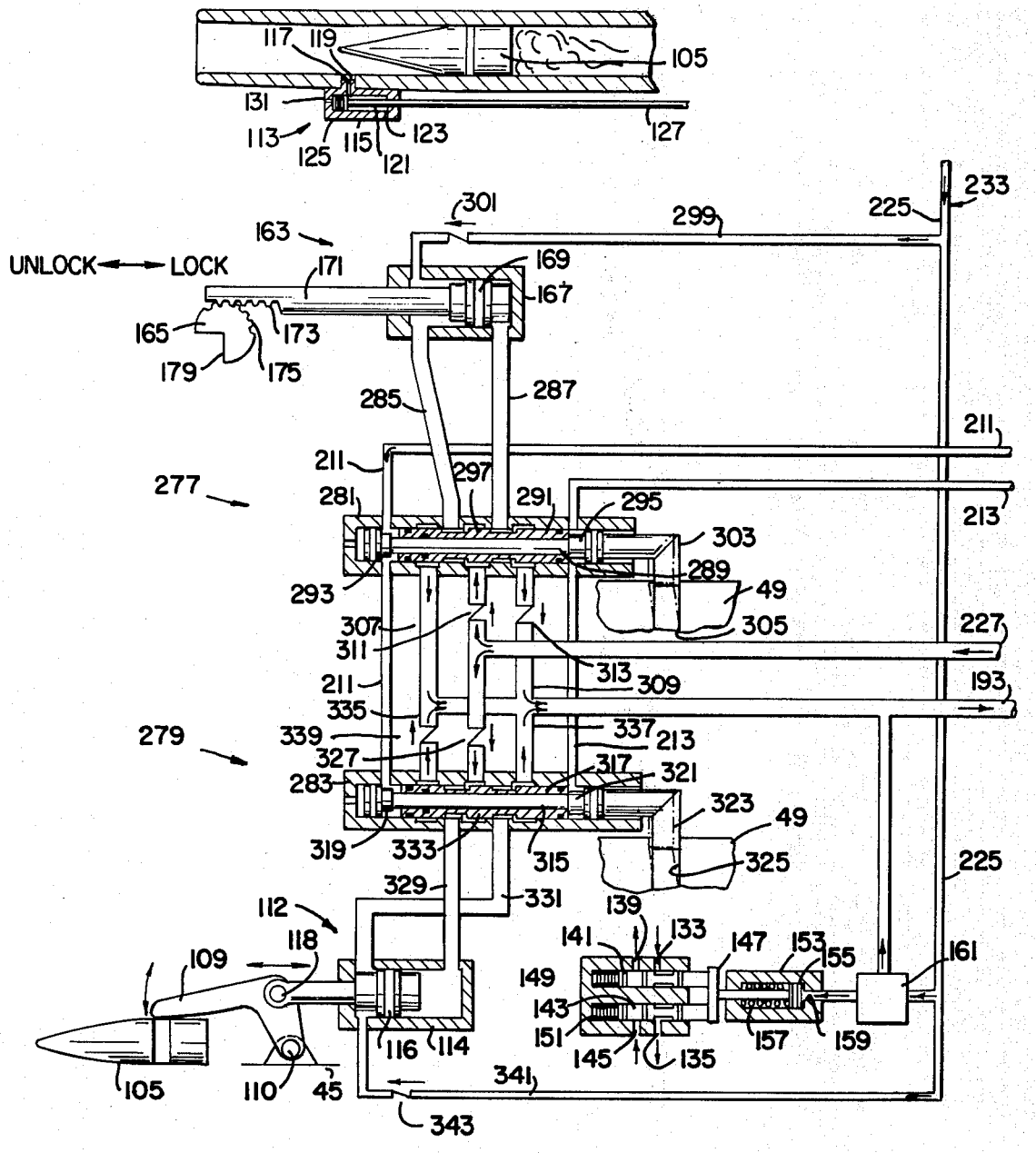
FIG. 14A and FIG. 14B are a schematic diagram of a hydraulic drive control system for a single gun module as shown in FIG. 1.
Figure 14B:
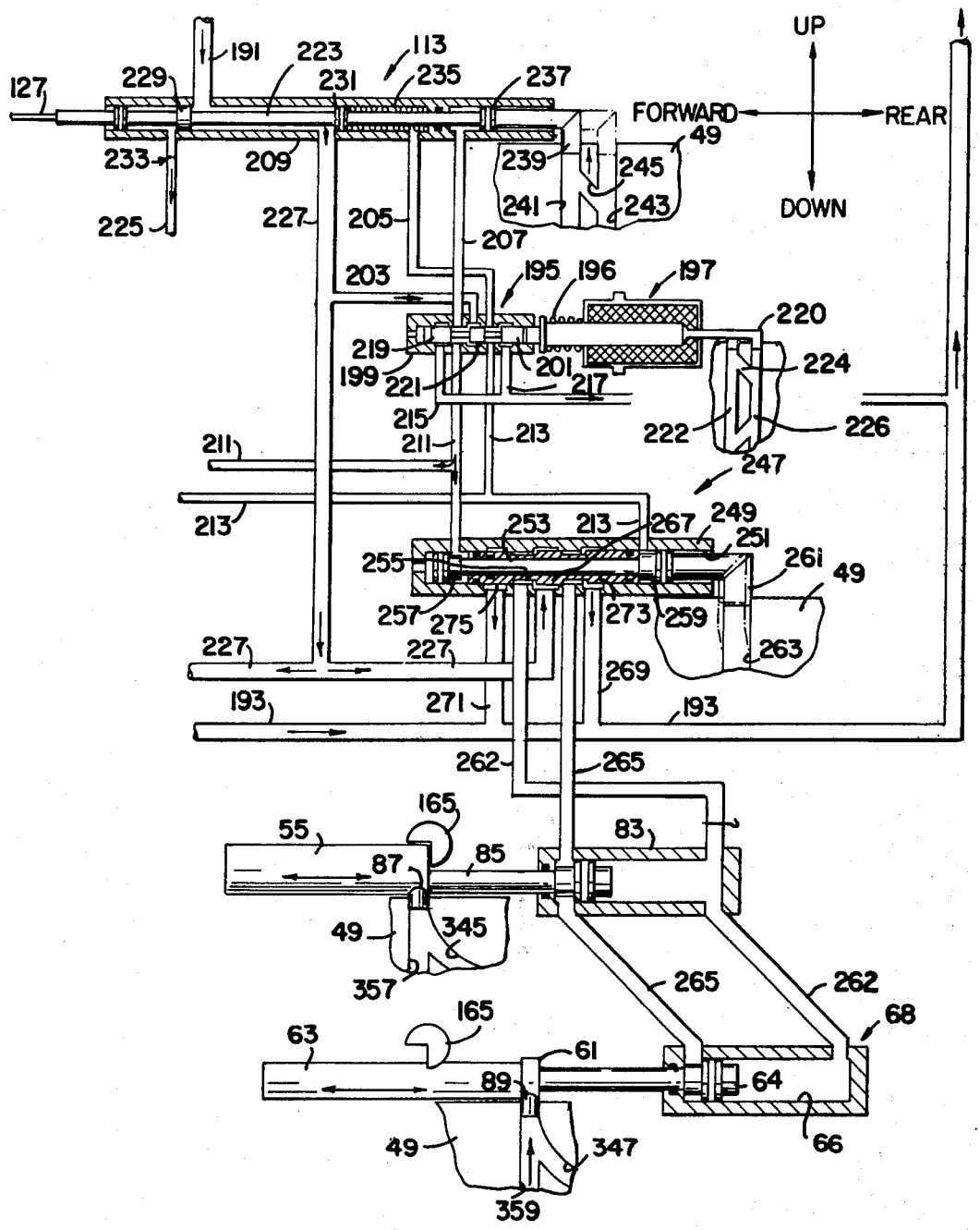

A hydraulic drive control system of the control assembly 37 is shown in schematic diagram in FIGS. 14A and 14B.

Figure 29:
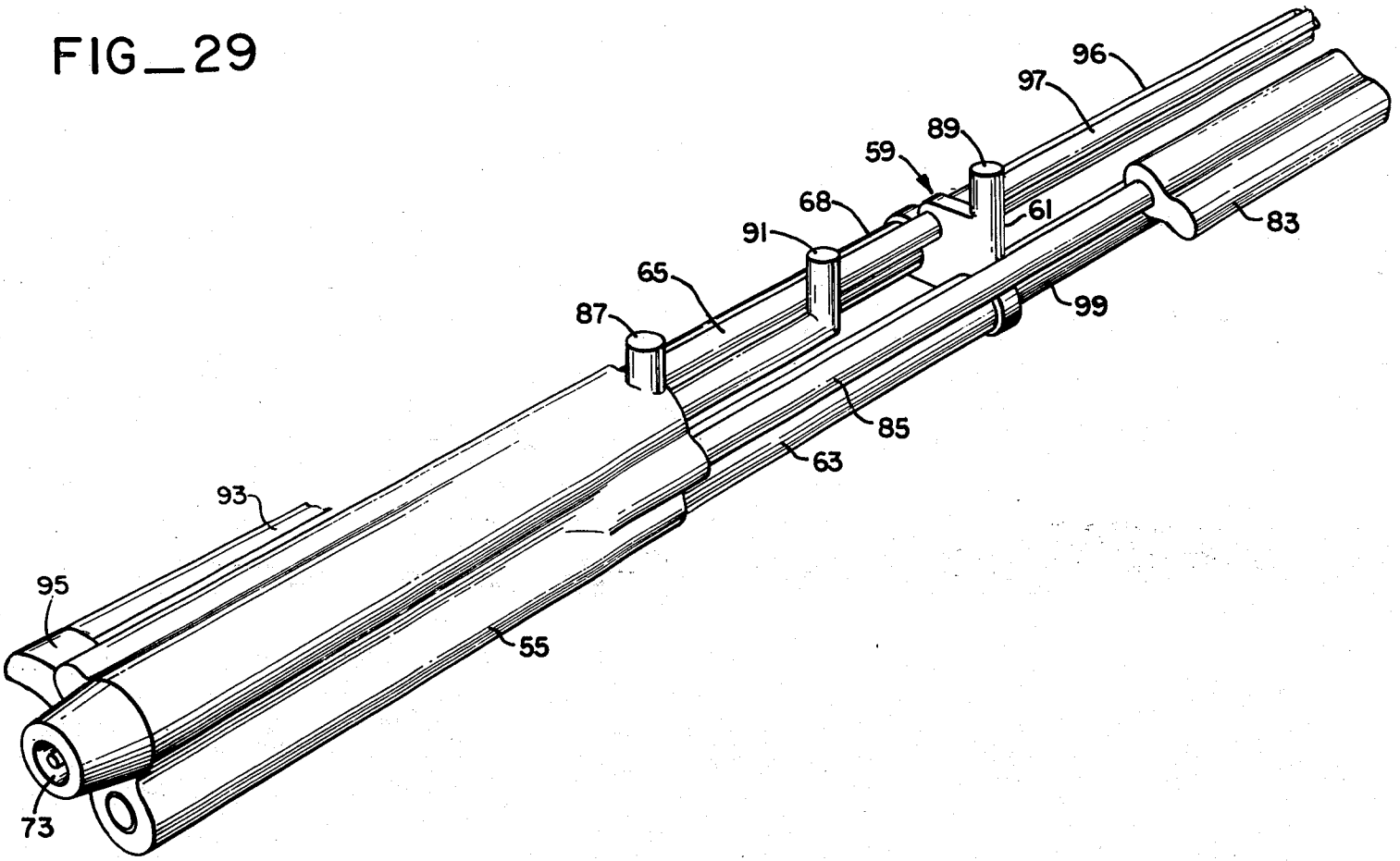
FIG. 29 is a pictorial view of the bolt and actuator sub-assembly.

The bolt and injector sub-assembly of the receiver assembly 35 is shown in FIG. 29.

Details of construction of the gun module 31 will now be described with reference primarily to FIGS. 3A and 3B and FIGS. 2A and 2B.

The barrel assembly 33 includes a barrel 43.

The receiver assembly 35 includes a receiver 45.

The receiver assembly 35 also includes an end plate 47 attached to the back end of the receiver 45 by a number of cap screws 46.

The hydraulic control assembly 37 is mounted on the receiver 45 in front of the end plate 47.

Figure 15:
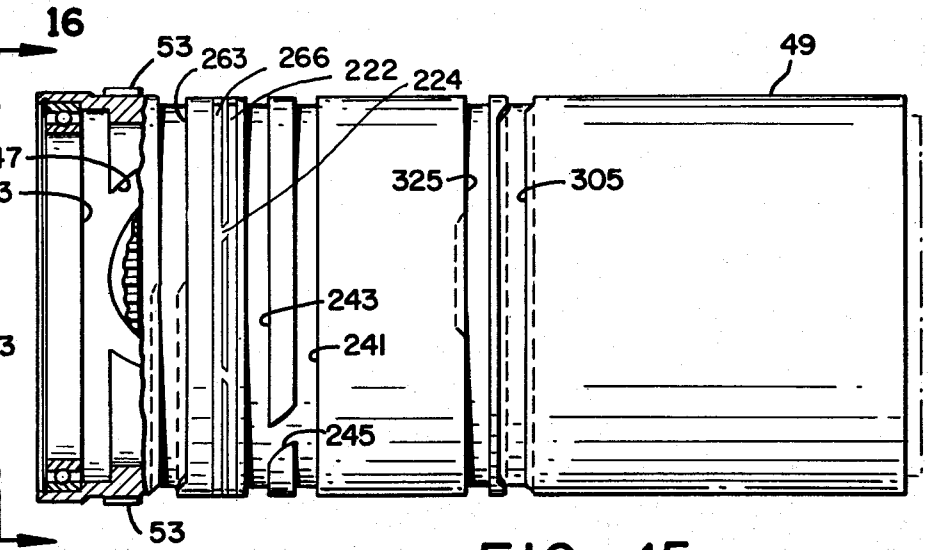
FIG. 15 is a top plan view of a cam having a hollow cylindrical configuration for use with four gun modules arranged in a circular grouping as best illustrated in FIG. 12. Parts of FIG. 15 have been broken away to show the cam faces on the interior surface of the hollow cylindrical cam.
Figure 16:
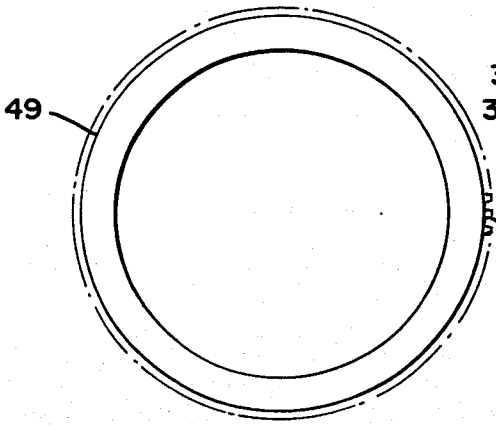
FIG. 16 is an end view of the cam shown in FIG. 15 and is taken along the line and in the direction indicated by the arrows 16—16 in FIG. 15.

A main cam 49 is mounted for rotation between the receiver 45 and the hydraulic control assembly 37. The main cam 49 is a hollow, cylindrical member (as best shown in FIGS. 15 and 16), and the rear end of the cam 49 is mounted for rotation on a bearing 51 in the end plate 47. The front end of the cam 49 may also be mounted for rotation on a bearing (not shown in the drawings) or may rotate on the receiver 45. The cam 49 has cam traces on both the inside and the outside peripheries. As will be described in greater detail below, the cam traces on the inside peripheries engage cam followers of actuators in the receiver 45 while the cam traces on the outside periphery engage cam followers of control valves in the hydraulic control assembly 37.

The cam 49 in the embodiment shown in FIG. 12 can be a rigid member. In other applications, e.g., the FIG. 13 embodiment, the cam 49 must be a flexible member to accommodate non-circular groupings of modules. As will become more apparent from the description to follow, a flexible cam is possible because of the low cam face loads of the present invention. The low cam face loads are possible because the cam does not drive the bolt assembly. The force for driving the bolt assembly is supplied by hydraulic actuators, and the cam serves only to maintain the proper phase relationship between the actuators and the control valves.

The cam 49 includes gear teeth 53 on the outside periphery of the cam. An electric or hydraulic motor (not shown in the drawings) drive the cam (in counterclockwise rotation as viewed in FIGS. 8-11) by means of the gear teeth 53.

The receiver 45 mounts a bolt 55 and propellant injection mechanism for reciprocation toward and away from combustion chamber 57 at the inlet end of the barrel 43.

The bolt and injector sub-assembly is best illustrated in FIG. 29. In FIG. 29 the propellant injection mechanism 59 includes a yoke 61, an acid piston 63, a fuel piston 65 and a hydraulic actuator 68. In the embodiment of the invention shown in FIGS. 2A, 2B, 3A, 3B and FIG. 29, the acid piston reciprocates within a cylinder 70 formed in the bolt 55, and the fuel piston 65 reciprocates within a cylinder 69 formed in the bolt 55.

The acid, or oxidizer, component of the bi-propellant is injected from the cylinder 67 through a port 71 into a central bore or pre-combustion chamber 73 of the bolt 55 and then into the combustion chamber 57.

The fuel in an aircraft installation may be the same fuel (such as JP 4) used for the aircraft engine. The fuel is injected from the cylinder 69 into the pre-combustion chamber 73 and the combustion chamber 57 through a port 72 shown in FIGS. 2A.

Piston 63 includes a one-way check valve 75 at the forward end of the piston.

The piston 65 includes a one-way check valve 77 at the forward end of the piston.

These check valves permit the fuel to flow through the interior of the pistons and through the head of the piston into the cylinder 700 and the cylinder 69 during the retraction strokes of the pistons within the cylinders 70 and 69.

The strokes of the pistons 63 and 65 are the same since the pistons are yoked together by the yoke 61. The proper mix ratio for the two components of the bi-propellant is obtained by the relative diameters of the pistons 67 and 65. The two components of the bi-propellant are therefore injected into the firing chamber in both metered amounts and in a constant mix ratio.

A spark plug 79 is mounted for reciprocation within the bolt 55 in a bore 81 which forms a continuation of a pre-combustion chamber 73.

The spark plug 79 closes off the propellant injection port 71 of the cylinder 67 and the port 72 for the cylinder 69 as the spark plug is moved forward during a cycle of operation to control the end of the propellant injection strokes.

As best shown in FIG. 29, the bolt is actuated by a hydraulic actuator 83 and an actuator rod 85.

The bolt 55 includes a bolt cam follower 87.

The fuel injection yoke 61 includes a cam follower 89.

The spark plug includes a spark plug cam follower 91.

With continued reference to FIG. 29, the hydraulic fluid for the propellant injection mechanism actuator 68 is brought in through a hydraulic line 93 and a hydraulic port 95.

The fuel for the fuel piston 65 is supplied through a fuel line 97.

The oxidizer for the acid piston 63 is supplied through a line 99.

The injector actuator 68 includes an inner bore 66.

An injector actuator hydraulic line 96 (see FIG. 4 and FIG. 29 and also FIG. 10) slides within the bore 66 in a trombone type arrangement as the injector yoke 61 is reciprocated back and forth by the action of the piston 67 within the bore 69.

Figures 2A, 3A, 4:
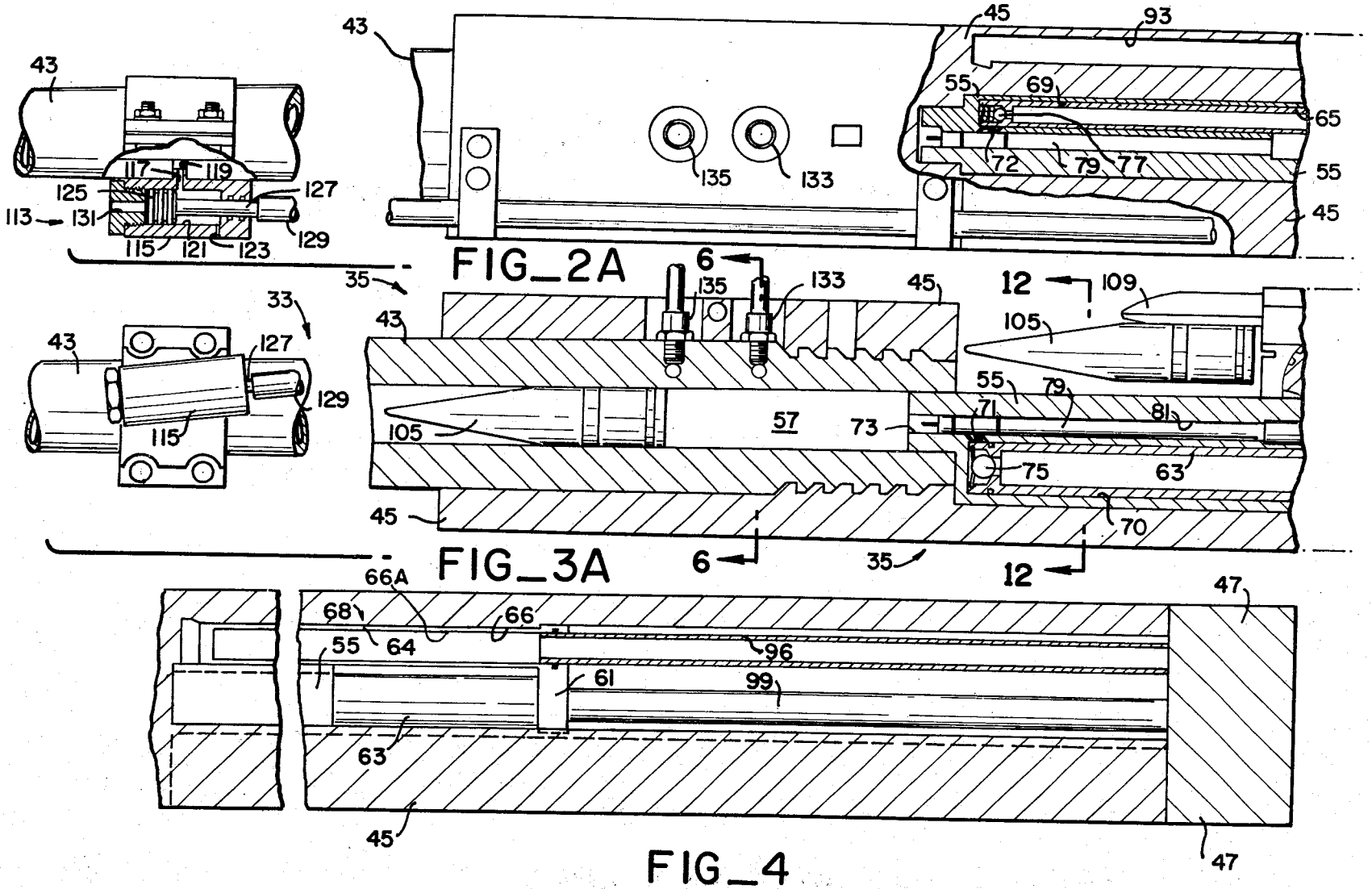
FIG. 2A and FIG. 2B are a plan view (partly broken away along the line and in the direction indicated by the arrows 2—2 in FIG. 11) of the gun shown in FIG. 1.
FIG. 3A and FIG. 3B are a side elevation view in cross section of the gun module shown in FIG. 1.
FIG. 4 is a fragmentary plan view taken generally along the line and in the direction indicated by the arrows 4—4 in FIG. 9.
Figure 2B:
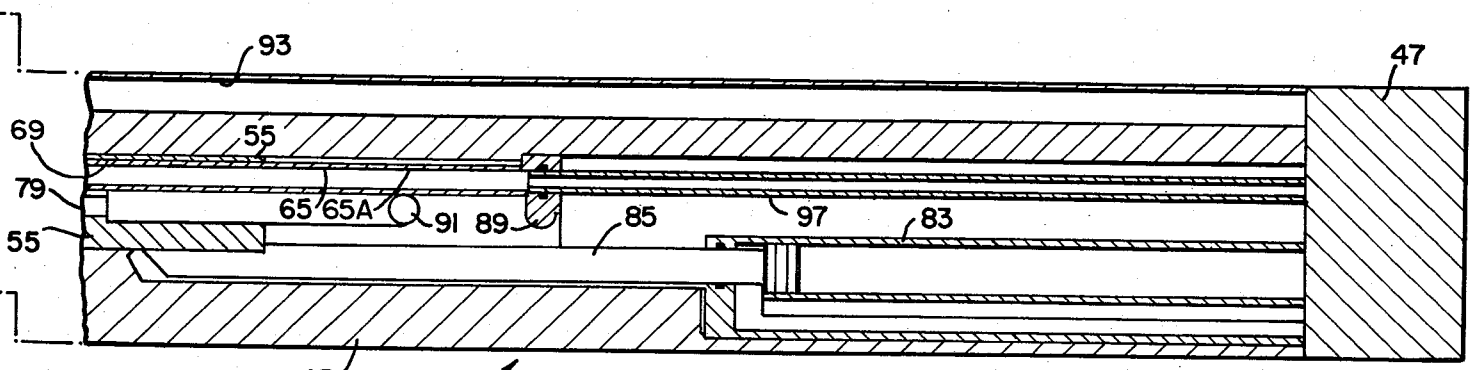
Figure 3B:
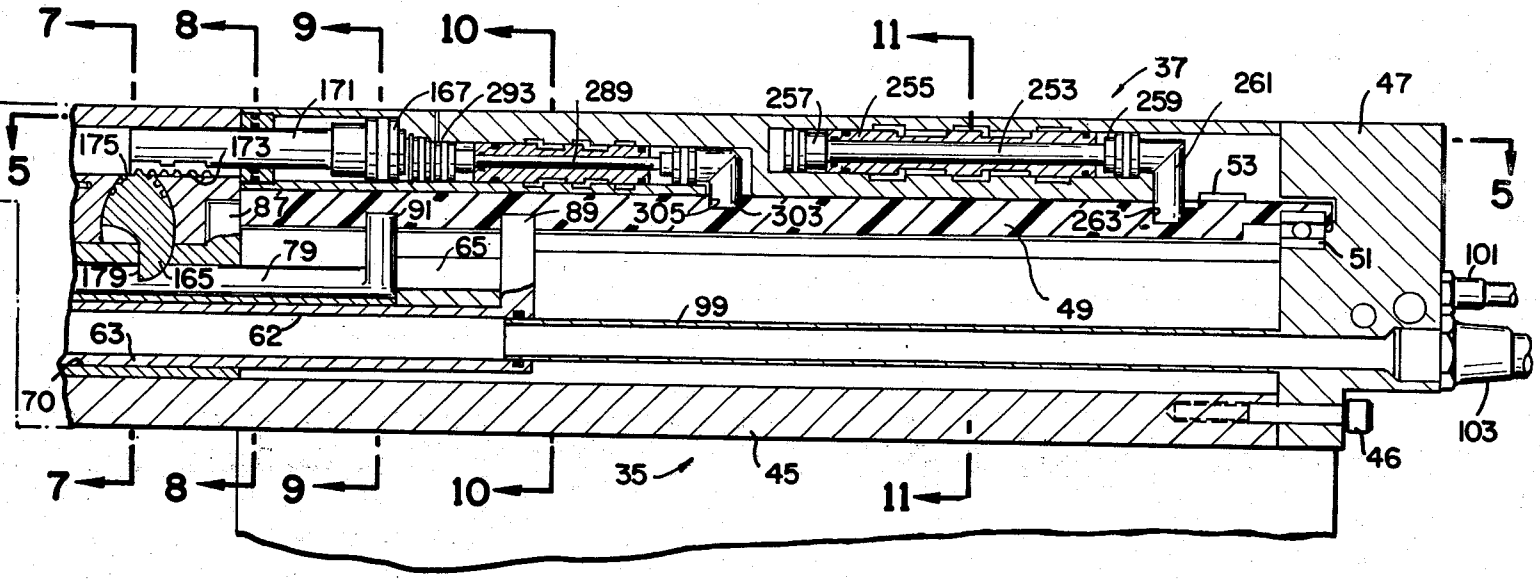
Figure 5:
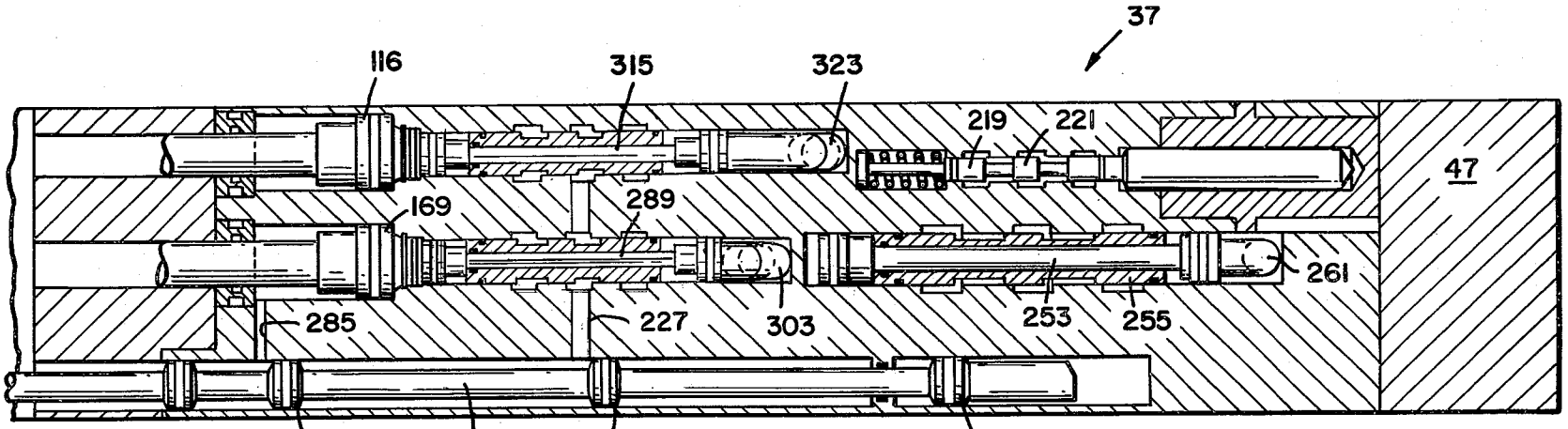
FIG. 5 is a fragmentary top plan view taken generally along the line and in the direction indicated by the arrows 5—5 in FIG. 3B.
Figure 7:
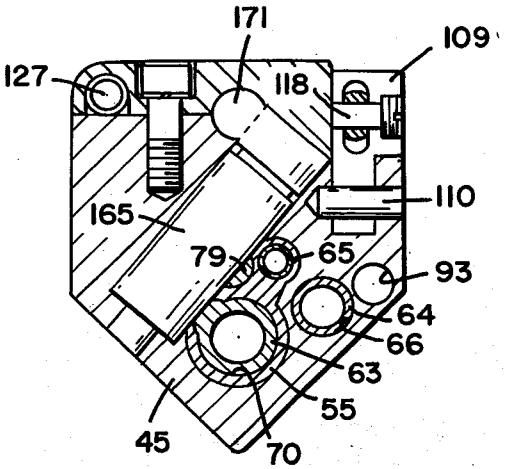
FIG. 7 is an elevation view taken along the line and in the direction indicated by the arrows 7—7 in FIG. 3B.

As best shown in FIGS. 2B and 3B, the fuel piston and fuel line and the acid piston and acid line also have similar trombone type arrangements.

Thus, the fuel piston 65 has a hollow interior forming a bore 64, and this hollow bore slides back and forth on the outside of the fuel line 97 during reciprocation of the piston 65 by the yoke 61.

The acid piston 63 has a bore 62, and this bore 62 slides back and forth on the exterior of the acid line 99 as the acid piston 63 is reciprocated by the yoke 61.

Suitable seal means, as shown in the drawings, are provided to accomplish the necessary sealing.

As best shown in FIG. 3B, the fuel line 97 is connected through the end plate 47 to a fuel port 101, and the acid line 99 is connected through the end plate 47 to an acid port 103.

FIG. 3A shows the bolt 55 at its full forward position.

A projectile 105, as shown in FIG. 3A, has been forced forward to the position illustrated by the forward movement of the belt 55 and also by the liquid propellant injected behind the projectile 105 into the firing chamber 57 by the forward movement of the fuel piston 65 and the acid piston 63. The projectile 105 is forced forward by the liquid propellant injected in the chamber 57. The forward motion is stopped by the resistance produced by the forcing cone. The way in which the projectile is located into the receiver and forced forward by the bolt and the liquid propellant insures that the firing chamber 57 and pre-combustion chamber 73 are completely filled with liquid propellant to eliminate an ullage problem.

The projectile 105 may preferably be fed to the receiver by a linkless belt 107 as shown in FIG. 12.

As shown in FIG. 12, (and as also shown in the lower lefthand corner of FIG. 14A), a projectile loader lever 109 bats a projectile 105 out of the belt 107 and into a curved slot 111 shaped to drop the projectile 105 into the proper position in the receiver assembly 31 in front of the bolt 55.

The projectile loader lever 109 is in the form of a bell crank (as best shown in FIG. 14A) and is pivotally connected to the receiver 45 by a pin 110.

The lever 109 is pivoted about the pin 110 by a hydraulic actuator indicated generally by the reference numeral 112 in FIG. 14A.

The actuatpr 112 includes a housing 114 and a piston 116 reciprocable within a bore in the housing. A rod of the piston 116 is connected to the lever 109 in a pin-joint connection 118.

As shown in FIG. 3A the projectile 105 in the receiver above the bolt 55 is positioned to be moved downward and in front of the front face of the bolt 55 by the lever 109 when the bolt 55 is retracted.

Each gun module 31 includes a misfire detection and module shutdown system. This system will be described in detail with reference to FIGS. 14A and 14B, but at the present time it should be noted that the system includes a detector mechanism indicated generally by the reference numeral 113 in FIG. 2A. The mechanism 113 includes a housing 115 clamped to the front end of the barrel 43 by bolts and nuts as illustrated. The housing 115 has a restricted orifice 117 which fits within an opening 119 in the barrel. The orifice 117 opens into a cylinder 121 in the interior of the housing 115. A second restricted orifice 123 also communicates with the interior of the cylinder 121 and extends through the wall of the housing 115 to connect the cylinder with the ambient atmosphere.

A piston 125 is reciprocable within the cylinder 121.

A piston rod 127 extends from the rearward end of the piston 125 through an end wall of the housing 115 and through a tube 129 back to a module shutdown control valve 223 as shown in FIG. 14B and as will be described in greater detail below.

An opening 131 extends through the front end wall of the housing 115 to vent the cylinder in front of the piston 125 to ambient atmosphere to prevent lock-up.

The orifices 117 and 123 are controlled orifices. The high pressure gas behind the projectile 105 enters the chamber within the cylinder 121 behind the piston 125 through the orifice 117 as the projectile is fired out of the barrel 43. The orifices 117 and 123 permit the escape of the pressurized gas from the interior of the housing 115 at a controlled rate to provide a certain leak down time. If another projectile is not fired within this leak down time the piston rod 127 is pulled back (to the right as viewed in FIG. 2A) by hydralic pressure exerted on a face of the control valve, as will be described in greater detail below with reference to FIG. 14B.

The detection mechanism 113 thus detects a misfire. The detection mechanism 113 remains in the position illustrated in FIG. 2A so long as the gun module continues in normal cyclic operation and does not misfire. On a misfire the piston 125 is shifted rearward (to the right as viewed in FIG. 2A).

As shown in FIGS. 2A and 3A an inlet port 133 and an outlet port 135 are connected to the top of the barrel 43 through openings in the receiver 45 for supplying fluid to the combustion chamber 57 to purge the chamber 57 in the event of a misfire.

Figure 6:
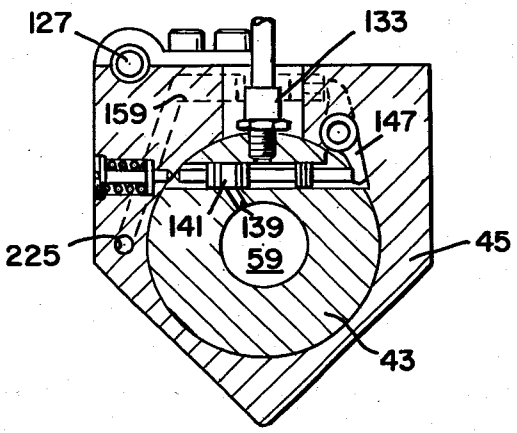
FIG. 6 is an elevation view taken along the line and in the direction indicated by the arrows 6—6 in FIG. 3A.
Figure 8:
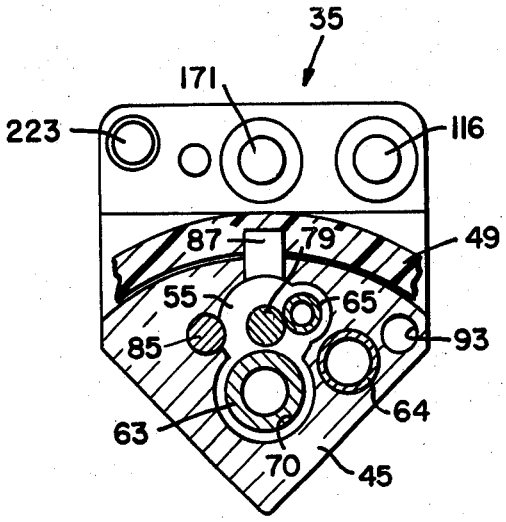
FIG. 8 is an elevation view taken along the line and in the direction indicated by the arrows 8—8 in FIG. 3B.
Figure 9:
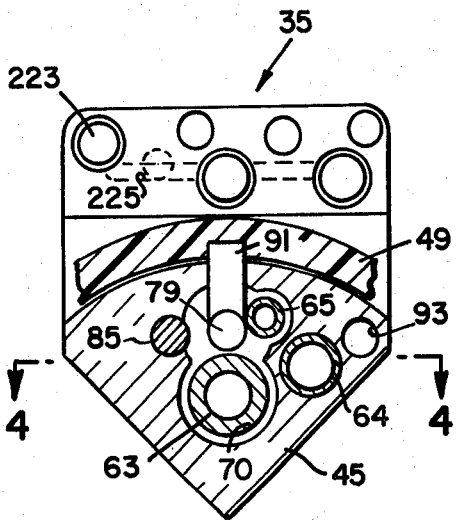
FIG. 9 is an elevation view taken along the line and in the direction indicated by the arrows 9—9 in FIG. 3B.
Figure 10:
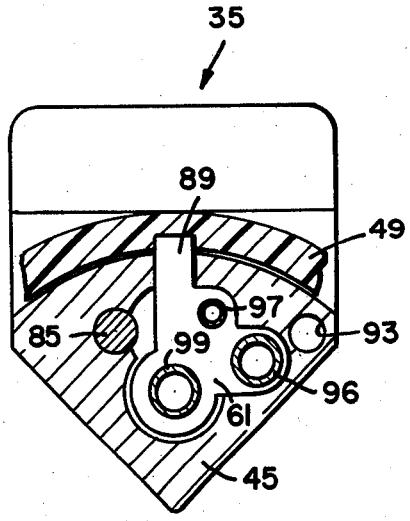
FIG. 10 is an elevation view taken along the line and in the direction indicated by the arrows 10—10 in FIG. 3B.
Figure 11:
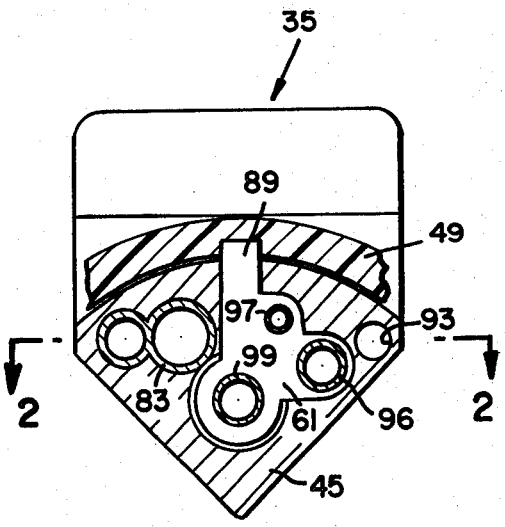
FIG. 11 is an elevation view taken along the line and in the direction indicated by the arrows 11—11 in FIG. 3B.

As best shown in FIG. 6 the fluid from the inlet port 133 flows into the combustion chamber 57 through a port 139 when a valve member 141 is positioned to permit flow between the ports 133 and 139.

As best shown in FIG. 14A a companion valve 143 controls the flow of the purge fluid out of the combustion chamber 57 through a port 145 (like the port 139) and through the outlets of 135 to sump. As shown in FIG. 14A the valve members 141 and 143 are yoked together by a yoke 147 and spring biased, by springs 149 and 151, to the positions illustrated in which the valve members close off the ports 139 and 145.

A hydraulic actuator 153, which includes a piston 155 spring biased by the spring 157 to the position illustrated in FIG. 14A, opens the ports 139 and 145 by moving the valve members 141 and 143 to the left as viewed in FIG. 14A when hydraulic pressure is admitted to the interior of the actuator 153 through the conduit 159. The flow of hydraulic fluid through the conduit 159 is under the control of a three-way time control valve 161. The three-way delay valve 161 is controlled by the misfire detection and module shutdown system, as will be described in greater detail with reference to the description of FIGS. 14A and 14B.

Figure 20:
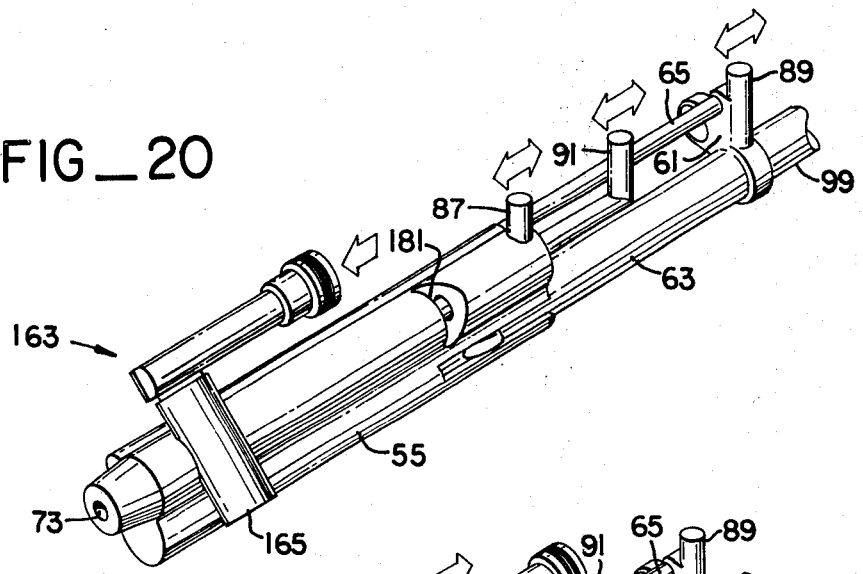
FIG. 20 is a pictorial view of one embodiment of a bolt locking mechanism for the gun module shown in FIG. 1.
Figure 21:
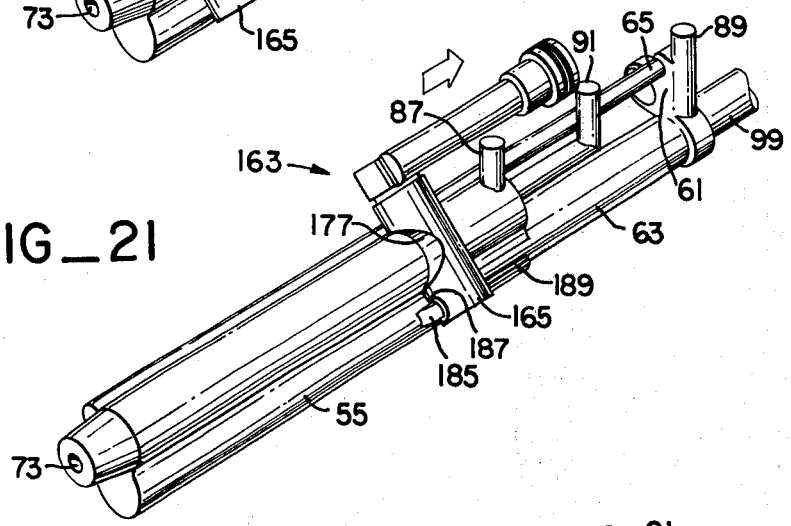
FIG. 21 is a view like FIG. 20 showing the lock mechanism in the locked mode.
Figure 22:
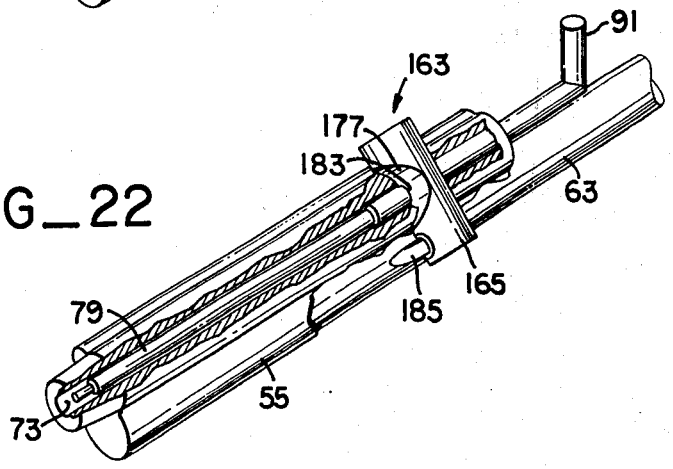
FIG. 22 is a view like FIG. 21 but with parts partially broken away to show details of construction.

As best shown in FIGS. 20–22 the gun module 31 includes a breech lock mechanism. This breech lock mechanism is indicated generally by the reference numeral 163 in FIGS. 20–22.

The breech lock mechanism, as best shown in FIG. 14A, includes a lock 165 and an actuator 167.

The actuator 167 includes a piston 169 and a rod 171. The forward end of the rod 171 has gear teeth 173 which engage corresponding gear teeth 175 on the lock. The rod 171, gear teeth 173 and gear teeth 175 form a rack-and-pinion arrangement for rotating the lock 165.

The lock 165 is a cylindrical member mounted for rotation about its longitudinal axis. The rotational axis of the lock 165 extends transverse to the axis of reciprocation of the bolt 55.

The lock 165 has a cutout or relieved area 177 which permits the lock to be mounted with the rotational axis of the lock closely adjacent to the outer periphery of the bolt 55. The relieved area 177 is shaped to, in effect, let the bolt reciprocate within the lock 165 with the outer periphery of the bolt in closely adjacent relationship to the surface of the cutout 177 of the lock when the lock is in the unlocked position.

The bolt 55 has a similar cutout or relieved area 181 which provides an abuttment face when the lock 165 is rotated into the cutout or relieved area 181.

Figure 23:
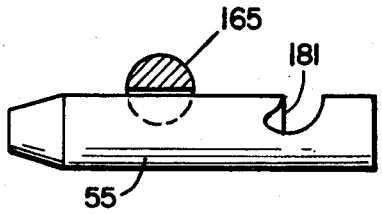
FIGS. 23 and 24 are side elevation views of the lock mechanism of FIGS. 20-21 showing the bolt and lock in the unlocked position in FIG. 23 and in the locked position in FIG. 24.
Figure 24:
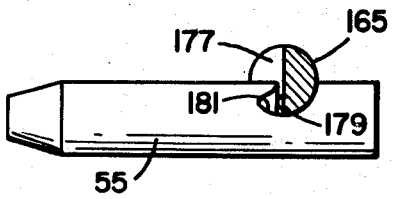
Figure 25:
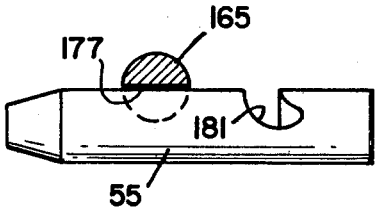
FIGS. 25 and 26 are view like FIGS. 23 and 24 of another embodiment of a lock mechanism constructed in accordance with the present invention.
Figure 26:
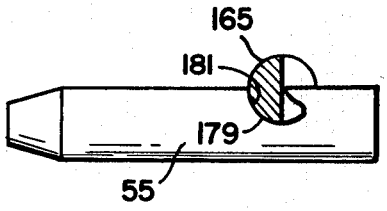
Figure 27:
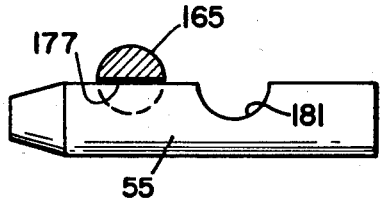
FIGS. 27 and 28 are views like FIGS. 23 and 24 of still another embodiment of the lock mechanism constructed in accordance with the present invention.
Figure 28:
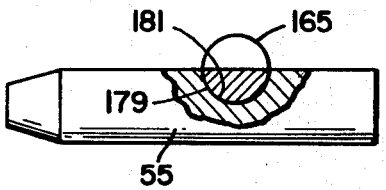

This action is best shown in FIGS. 23 and 24.

In the configuration of the parts shown in FIGS. 23 and 24 the lock 165 has an abuttment face 179. The face 179 abutts the corresponding abuttment face 181 of the bolt 55, which is a part of the relieved area 177 of the lock 165.

FIGS. 25 and 26 and FIGS. 27 and 28 show modified lock and bolt arrangements in which the abuttment face 179 of the lock is not part of the relieved area 177 of the lock.

In this instance, however, the abuttment face 179 of the lock engages a substantial part of the relieved area of the bolt in the locked position so that only a small force exerted by the actuator 167 is required to hold the bolt in the locked position.

Since the combustion pressure developed in the combustion chamber 57 is quite large, the force on the forward face of the bolt 55 during firing is also quite large. This force on the face of the bolt acts in a direction tending to open the bolt, and it is therefore important that the lock mechanism 163 be effective to hold the bolt in the locked position.

As best illustrated in FIG. 22 the spark plug 79 also has a cutout or relieved area which engages the lock 165 when the lock 165 is rotated to the locked position.

As also illustrated in FIGS. 21 and 22, the piston 63 of the propellant injection mechanism may also be formed with a locking element 185 projecting outwardly from the piston 63 for engagement with a locking face 187 of the lock 165 when the lock is rotated to the locked position.

The locking element 185 is slidable within a slot 189 of the bolt 65. The locking of the fuel injection mechanism is not as critical as the locking of the bolt 55 and the spark plug 79 because the fuel injection mechanism is not directly exposed to the combustion pressure within the combustion chamber 57.

Figure 17A:
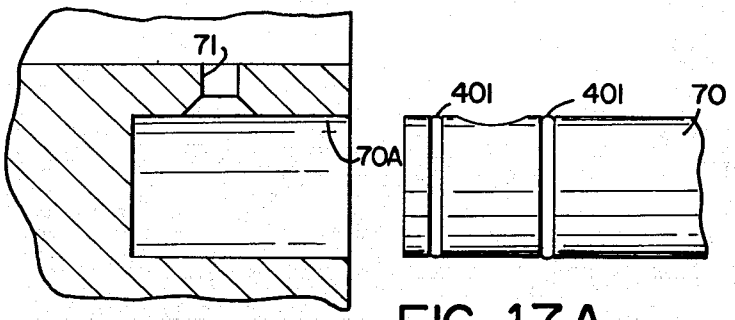
FIG. 17A illustrates how the propellant injection mechanism is retracted away from the firing chamber after the firing of a burst.
Figure 17:
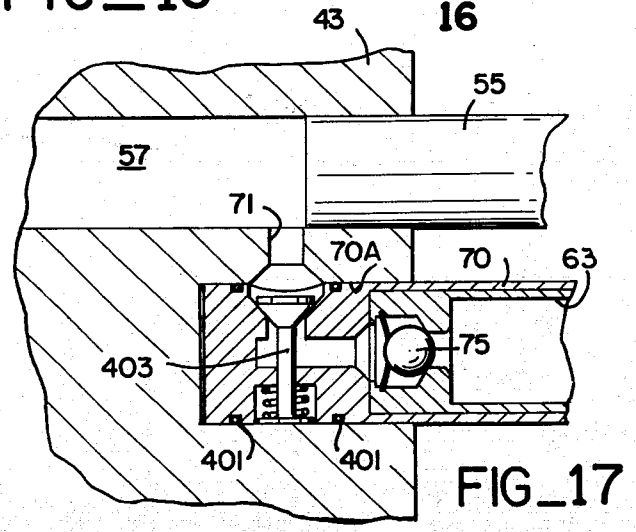
FIG. 17 is a fragmentary cross sectional view like FIG. 3A showing a modification of the fuel injection mechanism for the gun module shown in FIG. 1.

Before going to a discussion of the control mechanism shown in FIGS. 14A and 14B, it should be noted that FIGS. 17 and 17A illustrate a modification of a propellant injection mechanism. In these figures the cylinder 70 and piston 63 are mounted for reciprocation within a bore 66 formed in the barrel 43 and in the receiver 45 rather than in the bolt 55.

The cylinder 70 has a front end portion constructed to withstand the high pressures developed during combustion in the combustion chamber 57.

Seals, such as O-ring seals 401, prevent the loss of combustion chamber pressure. A spring biased check valve 403 is mounted in the front end portion of the cylinder 70 to permit the flow of propellant from the cylinder through the port 71 to the combustion chamber.

The piston 63 includes a one-way check valve 75 at the forward end of the piston.

In the operation of the embodiment shown in FIGS. 17 and 17A, the cylinder 70 remains in the forward position illustrated in FIG. 17 during the firing of a burst while the piston 63 reciprocates back and forth within the cylinder 70 during the firing of each round. After the firing of a burst, the entire cylinder 70 and piston 63 assembly is retracted to the position shown in FIG. 17A to isolate the propellant from the hot barrel 43.

The present invention retracts the propellant injection mechanism away from combustion chamber 57 so that the injection mechanism and the liquid propellant within the injection mechanism are physically isolated from the hot combustion chamber to provide a thermal barrier, that is, a physical barrier to prevent heat flow from the hot combustion chamber to the propellant. This eliminates problems of heat soak which can lead to cookoff or unwanted vaporization of fuel and combustion in the gun module 31. It is important to provide such thermal isolation after the firing of a burst. During firing the flow rates of the liquid propellant are normally high enough to provide sufficient cooling. Thus, while the FIG. 3A embodiment of the present invention discloses retraction after each individual firing, it should be recognized that it might be desirable in some instances to retract the entire injection only after the firing of a burst as in the FIGS. 17 and 17A embodiment.

In some instances, it may be desirable to include a low conductivity thermal barrier between the barrel and the receiver to further reduce the possibility of transfer of heat to the propellant after the firing of a burst.

A schematic diagram of the hydraulic drive control system for the gun module 31 as shown in FIGS. 14A and 14B. Pressurized hydraulic fluid for driving the various actuators is brought into the system through a line 191. The motor for producing this pressurized hydraulic fluid is preferably separate from the gun itself so that the gun can be kept light in weight and small in profile.

If the gun is installed in an aircraft the source of the pressurized hydraulic fluid can be the hydraulic system of the aircraft.

One of the features of a hydraulic control system is fast response. In the present invention the first shot is made at full cyclic rate.

The hydraulic fluid is returned from the control system to the source by a line 193.

The control system includes a bias control valve indicated generally by the reference numeral 195. The bias control valve is an on-off valve and is controlled by a trigger solenoid 197. The trigger solenoid 197 is shown in the "on" position in FIG. 14.

The bias control valve 195 includes a housing 199 and a valve spool 201 reciprocable within a bore in the housing 199.

Pressurized fluid flows into the housing 201 through an inlet conduit 203.

Outlet conduits 205 and 207 lead from the valve housing 199 to a housing 209 forming a part of the misfire detector mechanism 113. Outlet conduits 211 and 213 extend from housing 199 downward to other cnduits which are connected to ports at opposite ends of the various control valve housings. Outlet conduits 215 and 217 connect with the return conduit 193.

Lands 219 and 221 on the spool of the bias control valve control the flow through the various conduits.

The valve spool 201 includes a cam follower 220 which engages a trace 222 in the cam 49 in the armed condition of the system with the trigger solenoid in the off position. When the trigger solenoid is energized to the on position, the cam follower remains in the cam trace 222 until a crossover path 224 permits the cam follower to shift to the trace 226. This insures that the trigger solenoid will move the valve spool 219 to the on position in the proper time sequence with the other components of the hydraulic control system.

The valve housing 209 of the misfire detector mechanism 113 has a valve spool 223 mounted for reciprocation within the housing and connected to the rod 127. Outlet conduits 225 and 227 extend downward from the housing 209. Flow from the inlet conduit 191 and to the outlet conduits 225 and 227 is controlled by lands 229 and 231 on the valve spool 223. The conduit 225 contains an orifice 233.

A spring 235 acting on the backface of the land 231 biases the spool 223, and the rod 127, in a forward direction.

Pressurized fluid, conducted through the housing 209 by the conduit 207, acts on a forward face of a land 237 to bias the spool 223 in a rearward direction.

A cam follower 239 is connected to the rearward extension of the valve spool 223 and is normally engaged in a trace 241 of the cam 49. The cam trace 241 extends around the outside circumferance of the cam 49 and parallel to a second cam trace 243. A path 245 connects the traces 241 and 243.

As will be described in greater detail below in the description of the operation of the gun, the cam follower 239 remains in the trace 241 so long as a misfire does not occur. The pressure developed within the bore 121 of the housing 115 at the end of the barrel during cyclic firing is sufficient to keep the piston 125 forward, as illustrated, when the path 245 is aligned with the cam follower 239. However, if a misfire occurs, there is insufficient pressure in the chamber 121 behind the piston 125, and the force developed by the pressurized hydraulic fluid acting on the forward face of the land 237 shifts the valve follower 239 from the trace 241 through the path 245 and into the trace 243; and the cam follower 239 thereafter remains in the trace 243. This cuts off the flow of fluid through the conduit 227 and transmits pressurized hydraulic fluid through the conduit 225 by shifting the land 229 to the other side of conduit 191.

The phantom outline shows the cam follower 239 shifted to the trace 243.

In the misfire condition, the bolt 55 and injector 63 will remain locked in the forward position as illustrated. This mode of operation will be further described with reference to the cam traces shown in FIGS. 16 and 18 below.

The angle of the cam path 245 is such that the cam follower 239 will remain in the path 243 because of the direction of rotation of the cam 49. The valve spool 223 will thus remain in the rearward position illustrated by the phantom outline against the bias of the spring 235.

The conduits 211 and 213 extend from the bias control valve 195 down to a bolt and injector system control valve indicated generally by the reference numeral 247.

The control valve 247 includes a valve housing 249. The valve housing 249 has a longitudinally extending central bore 251.

A compound spool is axially shiftable within the bore 251.

The compound spool includes an inner spool 253 and a sleeve 255. The sleeve 255 is axially shiftable on the reduced diameter central portion of the spool 253 between abuttment stops 257 and 259 at opposite ends of the spool 253.

The conduit 211 connects to the forward end of the housing 249 and the conduit 213 connects to the rearward end of the housing 249. When pressurized fluid is supplied through the conduit 211 as illustrated in FIG. 14B the sleeve 255 is shifted rearward and into engagement with the stop 259. A cam follower 261 on the valve spool 253 rides in a trace 263 on the main cam 49. Rotation of the cam 49 periodically shifts the cam follower 261 forward to the position indicated by the dotted line to cause corresponding shifting of the valve spool 253 and the sleeve 255 engaged with stop 259.

Pressurized fluid is led into the control valve 247 by the conduit 227.

Conduits 262 and 265 extend from the valve housing 249 to the rear ends and to the front ends respectively of the actuators 83 and 68 for the bolt 55 and the yoke 61 of the propellant injection mechanism.

With the cam 49 in the position illustrated and the valve sleeve 255 pressed against the stop 259 of the spool 253, the pressurized fluid flows from the conduit 227 past a land 267 and to the conduit 262 and the back sides of the actuators 83 and 68. The respective pistons and the actuators are thus forced forward to the positions illustrated in FIG. 14B.

When the cam 49 rotates to a position in which the trace 263 shifts the cam follower 261 to the dotted line position shown in FIG. 14B the land 267 closes off flow through the conduit 262 and directs the flow to the conduit 265 to reciprocate the pistons in the bolt actuator 83 and the propellant injection actuator 68 to the rear.

In this mode of operation the control valve 247 acts as an on-off valve or flow switching valve to cause reciprocation of the bolt and propellant injection mechanism with the movement of the cam follower 261. Conduits 269 and 271 extend downward from the valve housing 249 and connect with the return conduit 193. Flow through these conduits 269 and 271 is controlled by lands 273 and 275 on the valve sleeve 255. These lands open one side of each of the actuators 83 and 68 to hydraulic fluid return when the other side of each actuator is being pressurized.

Pressurized hydraulic fluid is supplied through the conduit 213 to shift the sleeve 255 forward against the stop 257 when the gun is placed in the armed condition (a condition in which the main cam drive motor is energized, the main cam is rotating and hydraulic power is applied to the gun module) and the trigger solenoid 197 is in the off position. In this condition of operation the reciprocation of the spool 253 by the cam trace 263 is not effective to produce any reciprocation of the bolt and propellant injectors. Instead, pressurized hydraulic fluid is continuously transmitted from the conduit 227 to the conduit 265 past the land 267 and to the forward end of the actuators 83 and 68. The bolt and propellant injectors are thus held in the open position ready to start firing as soon as the trigger solenoid 197 is energized to the on position.

As illustrated in FIG. 14A the hydraulic drive control system includes a breech lock control valve indicated generally by the reference numeral 277 and a projectile loader control valve indicated generally by the reference numeral 279.

These control valves control the breech lock actuator 163 and the projectile loader actuator 112.

The control valves 277 and 279 are compound spool control valves like the bolt and injector control valve 247 and operate in a dual mode like the control valve 247.

Thus, a conduit 211 is connected to the forward end of a valve housing 281 of the control valve 277 and the conduit 211 is also connected to the forward end of a valve housing 283 of the control valve 279.

A conduit 213 is connected to the rearward end of the housing 281 and a rearward end of the housing 283. Pressurized hydraulic fluid is supplied to a central part of each valve housing 281 and 283 by the conduit 227 during normal operation.

The pressurized fluid from the line 227 is directed alternately to the front and to the back side of the breech lock actuator 167 through conduits 285 and 287.

The breech lock control valve 277 includes a compound spool. The compound spool has an inner spool 289 and a valve sleeve 291. The valve sleeve 291 is shiftable on the spool 289 between the stops 293 and 295.

A land 297 controls the flow of fluid from conduit 227 to the conduits 285 and 287.

On a misfire, pressurized fluid from the main hydraulic line 191 is directed to the conduit 225 (see FIG. 14B), through an orifice 233, and, in the case of the breech lock actuator 163, through a conduit 299 and a one-way check valve 301 to the front end of the housing 167 to hold the breech lock in the locked position illustrated.

During normal cyclic firing operation pressurized hydraulic fluid is supplied to the front end of the housing 281 of the breech lock control valve to position the sleeve 291 against the stop 295 as illustrated in FIG. 14A.

A cam follower 303 on the valve spool 289 rides in a trace 305 on the cam 49. As the cam 49 rotates, the trace 305 periodically shifts the cam follower 303 to the forward position illustrated by the dotted outline. This in turn shifts the valve spool 289 and the valve sleeve 291 to produce reciprocation of the piston 169 in the breech lock actuator. Conduits 307 and 309 connect the valve housing 281 with the return line 193.

In the trigger off but armed condition pressurized hydraulic fluid is directed through the conduit 213 to the rear face of the sleeve 291 to move the sleeve forward against the stop 293. In this condition of operation, the breech lock actuator is maintained in the unlocked position ready for the start of firing. The reciprocation of the valve spool 295 by the cam follower 303 is not effective to change the flow of pressurized hydraulic fluid from the conduit 287 to the back side of the piston 169.

The conduit 227 includes a one-way check valve 311 and the conduit 309 includes a one-way check valve 313 for preventing bleed-off of pressure from the front part of the hydraulic actuator 167 during a misfire condition in which the breech lock is maintained in the locked position.

The projectile loader control valve 279 includes an inner valve spool 315 and a valve sleeve 317. The valve spool 315 has stops 319 and 321 at opposite ends of the valve spool. A cam follower 323 rides in a trace 325 on the cam 49 and is shiftable between the solid line position and the dotted line position shown to reciprocate the valve spool 315.

Pressurized hydraulic fluid supplied to the forward end of the valve housing by the conduit 211 during normal cyclic firing operation shifts the valve sleeve 317 rearward against stop 321 as illustrated.

Pressurized hydraulic fluid supplied through the conduit 213 to the rearward end of the valve housing 283 shifts the valve sleeve 317 forward against the stop 319 during the armed but non-firing condition of the gun.

Pressurized hydraulic fluid from the conduit 227 flows past a one-way check valve 327 and into the central part of the bore within the housing 283. From there the pressurized fluid flows either through a conduit 329 to the rearward end of the projectile loader actuator or through a conduit 331 to the forward end of the projectile loader actuator 112. The flow of pressurized fluid through the conduit 329 and 331 is controlled by a land 333 on the sleeve 317. Fluid is returned to the return line 193 from the housing 283 by conduits 335 and 337. The conduit 335 contains a one-way check valve 339.

A conduit 341, having a one-way check valve 343 connects the forward end of the actuator 112 with the conduit 225. When the misfire detection mechanism directs pressurized fluid through the conduit 225 to the projectile loader actuator 112, the actuator is moved rearward to hold the projectile loader in an open position.

It is an important feature of the present invention that several of the controlled elements are interlocked through the cam to the control valve controlling these components.

Thus, both the bolt and the propellant injectors are interlocked through the cam to the bolt and injector control valve. This insures precise phase relationship between the control valve and the actuators and also precise phase relationship between actuated components. Because hydraulic boost is used for actuation, cam face loadings are quite low. And because of the interlock a simple on/off flow switching valve can be used without the need for expensive and complex feedback mechanisms of conventional hydraulic servo motor systems.

Figure 18:
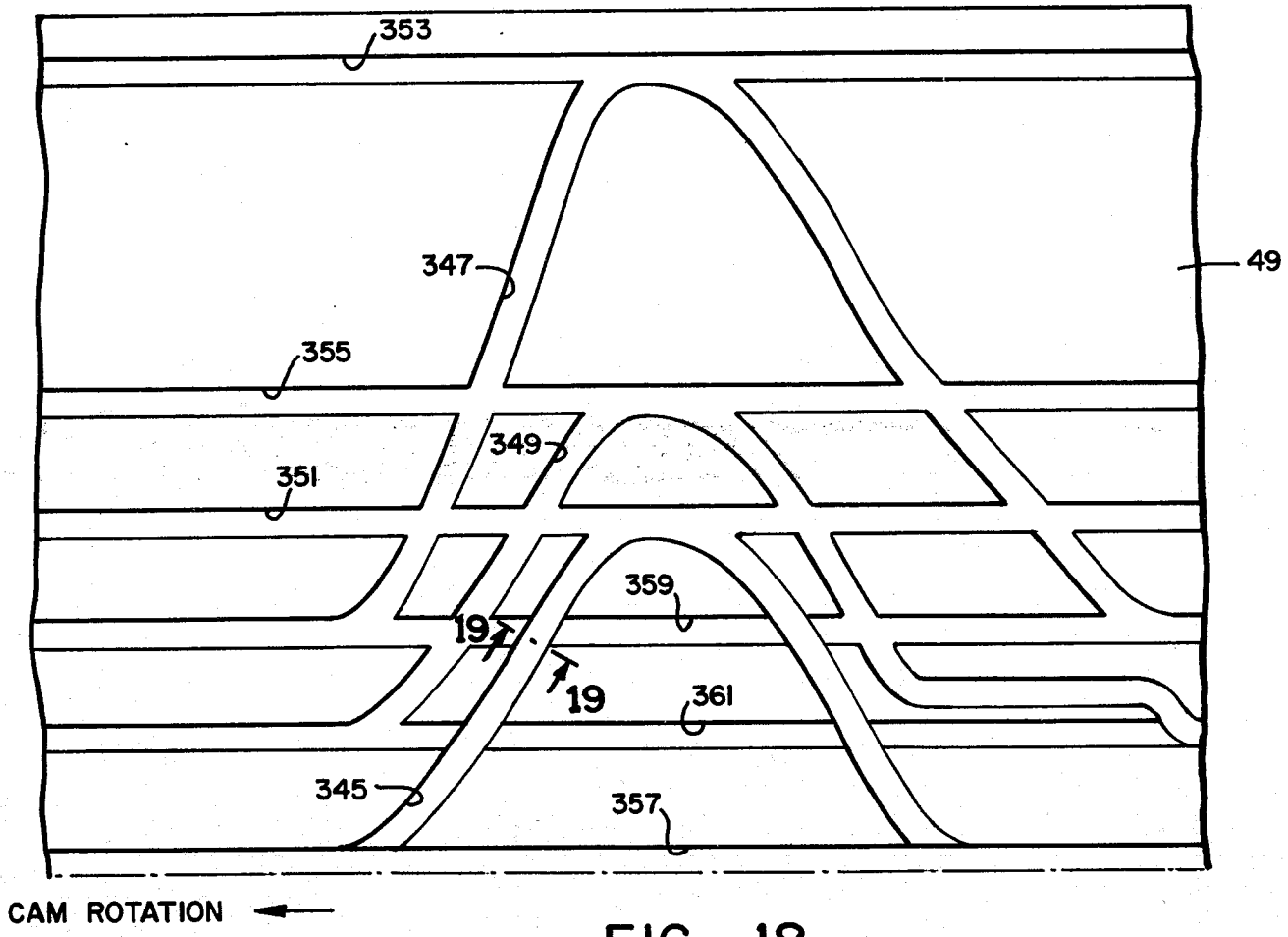
FIG. 18 is an inside developed view of the inside surface of the hollow cylindrical cam shown in FIG. 15.
Figure 19:
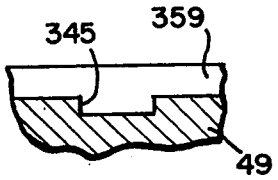
FIG. 19 is a fragmentary cross section view taken along the line and in the direction indicated by the arrows 19—19 in FIG. 18.

As illustrated in FIG. 14B, the cam follower 87 of the bolt 55 rides in a trace 345 during normal cyclic firing of the gun. As best shown in FIG. 18 this trace 345 is located on the inner periphery of the cam and accommodates the reciprocatory motion of the bolt.

The cam follower 89 of the propellant injection mechanism rides in a trace 347 during normal cyclic firing of the gun.

The spark plug cam follower 91 rides in a trace 349 during normal cyclic firing of the gun.

The traces 345, 347 and 349 connect with straight through traces 351, 353 and 355 respectively as illustrated in FIG. 18. These straight through traces are the traces in which the cam followers ride during the open bolt static condition after the gun has been armed but before the trigger solenoid 197 has been moved to the on position to initiate firing.

The traces 345, 347 and 349 also connect with additional straight through traces 357, 359 and 361 respectively as illustrated in FIG. 18. These last three straight through traces provide the paths for the respective cam followers in the closed bolt or misfire condition of operation.

The cam 49 is rotated in the direction indicated in the drawings by a hydraulic motor or other suitable drive means engaged with the gear teeth 53.

The operation of the gun module 31 will now be described. The mechanical operation of the gun will be described first, and the operation of the hydraulic control circuit will then be summarized.

The following is a description of the operation of the gun mechanism.

When the gun is placed in the armed position, the main cam drive motor (not shown in the drawings) is energized and hydraulic power is supplied to the gun module through the main hydraulic supply line 191.

If the trigger is in the off position, the hydraulic control system (shown in FIGS. 14A and 14B) will unlock the breech lock 165 and will position the projectile loader lever in the up position. The bolt 55 and the injector yoke 61 will be positioned in the rear position. As long as the gun is in the armed condition with the trigger off these components will remain in these positions. This is generally referred to as the open bolt position.

When the trigger solenoid 197 is put into the on position, the hydraulic control system and main cam 49 will cover the following sequence of events:

1. The projectile loader lever 109 moves down, forcing a new projectile 105 into the loading tray 111.

2. The bolt 55 moves forward, ramming the projectile 105 into the combustion chamber 57. When the bolt 55 is fully forward, the breech lock 165 is locked.

3. The injector pistons 63 and 65 initially move forward with the bolt 55. However, until the bolt 55 stops, there will be no relative movement between the injector pistons 63 and 65 and the bolt 55. When the bolt 55 stops, the injector pistons 63 and 65 continue to move forward, injecting a charge of fuel and acid through the pre-combustion chamber 73 and then into the combustion chamber 57. The injected propellant will force the projectile 105 forward as it is injected. Since the diameter and stroke of the fuel and acid pistons 65 and 63 are constant, each forward motion of the injectors will meter a fixed propellant charge with a constant, predetermined mixture ratio.

4. When the injector pistons 63 and 65 are fully forward and the injection is completed, the spark plug 79 is moved forward sealing off the injection ports 71 and 72. It should be noted at this point that in the case of the mono-propellant, metering of the propellant can be accomplished without the need for a cut-off valve. In the case of a mono-propellant, it is often possible to use tank pressure without a hydraulic boost for injecting the propellant into the firing chamber. The injection of the mono-propellant can start by putting the fuel into the chamber behind the projectile simply by opening a valve. The mono-propellant continues to flow into the combustion chamber behind the projectile until the resistance to continued forward movement of the projectile produced by the forcing cone is greater than the force developed by the pressurized fuel on the back face of the projectile. At that point the projectile stops and a metered amount of propellant is in the firing chamber.

5. When the spark plug 79 is full forward, electrical power is supplied to the spark plug; and the gun is fired.

6. The breech lock 165 is then unlocked.

7. The projectile loader lever 109 moves to the up position.

8. The bolt 55 and injector pistons are driven to the rear. When the rearward movement of the bolt 55 stops, the rearward movement of the injector pistons 63 and 65 continues for the length of the stroke of the pistons. As the pistons move to the rear, propellant, (i.e., acid and fuel) flows through the ball check valves 75 and 77 and fills the volumes created by the rearward movement of the pistons relative to the bolt. The pistons are, in effect, drawn backwards through the propellant to fill the injector cylinders during retraction of the pistons. This is the charge that will be injected into the firing chamber 57 for the next round.

9. The next firing cycle is then repeated.

10. In the event of a misfire, the misfire detection mechanism 113 and module shutdown valve 223 will shut off the hydraulic supply (see the hydraulic control circuit of FIGS. 14A and 14B). The breech lock 165 will be locked, the projectile loader lever 109 will go to the up position, and the bolt 55 and injector pistons 63 and 65 will be forced to the forward position. The misfired module will remain in the shutdown position until maintenance can be performed. However, the other modules of the gun cluster remain in operation.

The operation of a hydraulic control circuit is believed to be evident from the detailed description of FIGS. 14A and 14B above but will now be summarized.

The hydraulic control circuit illustrated in FIGS. 14A and 14B has three basic elements. The basic elements of the circuit are:

1. The primary control components. These components include the misfire detection mechanism 113 and the module shutdown valve 223. The primary control components also include the bias control valve 195.

2. The secondary control components. The secondary control components include the bolt and injector system control valve 247, the projectile loader control valve 279 and the breech lock control valve 277.

3. The auxilliary control components. The auxilliary control components include the gun purge valves 141 and 143 and the three-way time delay valve 161 and the valve actuator 153.

The primary control components consist of the misfire detection mechanism 113 and the module shutdown valve 223 and the bias control valve 195. The bias control valve 195 is operated by the electrical solenoid 197, which in turn is controlled by the gun trigger. The bias control valve 195 controls the hydraulic fluid supply to the secondary control valves.

The design and operation of the secondary control valves is a unique feature of the present invention and is fundamental to the operation of the hydraulic control circuit. The bolt and injector system control valve 247 is typical of the secondary control valves. The valve 247 consists of the outer valve body 249, the hydraulically operated sleeve 255 and the cam-operated inner spool 253. The cam follower 261 attached to the rear end of the spool 253 engages the groove 263 of the cam 49. As the cam 49 rotates, the spool is caused to translate forward and rearward in the outer valve body. The spool is shown in FIG. 14B in is rear position (the dotted line illustrates the maximum forward position of the cam follower). The sleeve 255 is concentric to the spool and its position relative to the spool is controlled hydraulically by means of the bias control valve 195. Hydraulic pressure applied to the front end of the sleeve 255 will force the sleeve rearward against the rear stop 259 of the spool 253, and hydraulic pressure applied to the rear of the sleeve 255 will force the sleeve forward against the forward stop 257 of the spool. In either the forward or the rear position relative to the spool, the sleeve will translate forward and rearward in the outer valve body 249 as the piston moves. The position of the sleeves with respect to the spool in each of the secondary control valves 247, 277 and 279 is controlled by means of the bias control valve 195, which, in turn, is actuated by the trigger solenoid 197. When the trigger solenoid 197 is energized, the bias control valve 195 is pulled to the rear, thus allowing hydraulic fluid to flow to the forward end of all of the secondary control valves. This forces the sleeves rearward against the rear stops of the related spools. When the trigger solenoid 197 is deenergized, the trigger solenoid spring 196 pushes the bias control valve forward. This allows hydraulic fluid to flow to the rear end of all the secondary control valves and forces the sleeves forward against the forward stops of the related spools.

The relative positions of the various components in respect to the cam follower and sleeve position are tabulated in the following table I.

TABLE I

BOLT, INJECTOR, BREECH LOCK, AND PROJECTILE LOADER POSITIONS AS A FUNCTION OF SLEEVE* AND CAM* POSITION

| Sleeves | Forward (Trigger Off) | Rear (Trigger On) | |
|---|---|---|---|
| Cam Follower Position | Forward or Rear | Rear | Forward |
| Bolt & Bolt Actuator | Rear | Forward | Rear |
| Injector & Injector Actuator | Rear | Forward | Rear |
| Breech Lock Actuator | Forward | Rear | Forward |
| & Breech Lock | Unlocked | Locked | Unlocked |
| Projectile Loader Actuator | Rear | Forward | Rear |
| & Projectile Loader Lever | Up | Down | Up |

*Sleeves and cam followers on bolt and injector actuator valve, breech lock control valve and projectile loader control valve When the trigger is in the off condition, the bias valve 197 is forced forward by a bias control spring 196. Hydraulic fluid flows to the rear of each of the secondary control valves 247, 277 and 279, thus forcing the sleeves into the forward position. With the sleeves in the forward position, the bolt and injector control valve 247 will allow hydraulic fluid to flow to the forward port of the bolt actuator 83 and to the forward port of the injector actuator 69, thus forcing the bolt 55 and the injector pistons 63 and 65 to the rear. The breech lock control valve 277 allows hydraulic fluid into the rear chamber of the breech lock actuator 167 which forces the breech lock forward into the unlocked position.

The projectile loader control valve 279 allows hydraulic fluid to flow into the forward chamber of the projectile loader actuator 112, forcing it rearward and causing the projectile loader level 109 to move into the up position. As the cam 49 rotates, the cam followers and systems on all the secondary control valves 247, 277 and 279 will translate forward and backward. The sleeves will translate with the piston. However, in this trigger off condition, the valve ports are arranged so that the bolt 55, injector pistons 63 and 65, projectile loader level 109, and breech lock 154 will remain in position as the sleeves translate.

When the trigger is energized or on, the bias control valve 195 moves rearward, and hydraulic fluid flows to the forward chambers of the secondary control valve 247, 277 and 279 forcing the sleeves to the rear. The sleeves will translate with the valve spools as the main cam 49 rotates. However, with the sleeves in the rear position, the valve ports are arranged so that the following is accomplished:

In the bolt and injection control valve 247, with the sleeves positioned to the rear, translation of the spool 253 and the sleeve 255 forward as the main cam 49 rotates allows hydraulic fluid to flow to the forward chamber of the bolt actuator 83 and the injector actuator 68, thus forcing the bolt 55 and the injector pistons 63 and 65 to the rear. Translation of the spool 253 and sleeve 255 rearward allows hydraulic fluid to flow to the rear chamber of the bolt and injector actuators, thus forcing the bolt and injector piston forward.

In the breech lock control valve 277 with the sleeve 291 in the rear position, translation of the sleeve 291 and spool 289 forward as the main cam 49 rotates allows hydraulic fluid to flow into the rear chamber of the breech lock actuator 163, forcing it forward and unlocking the breech. Translation of the sleeve and spool to the rear allows hydraulic fluid to flow into the forward chamber of the breech lock actuator 163, forcing it rearward and locking the breech.

In the projectile loader control valve 279 with its sleeve 317 in the rear position, translation of the sleeve 317 and spool 315 forward as the main cam 49 rotates allows hydraulic fluid to flow to the forward chamber of the projectile loader actuator 112 forcing the actuator rearward and positioning the projectile loader lever 109 in the up position. Translation of the sleeve and spool to the rear allows hydraulic fluid to flow to the rear chamber of the projectile loader actuator 112 forcing it forward and positioning the projectile loader lever into the down position.

Sequencing of the movement of the bolt 55, injector piston 63 and 65, breech lock 165 and the projectile loader lever 109 are controlled by the design of a main cam 49. One revolution of the main cam 49 will result in one cycle of operation of the bolt, injectors, breech lock and projectile loader with trigger in the on position.

The other primary control components are a misfire detection mechanism 113 and a module shutdown valve 223. The main function of the module shutdown valve 223 is to shut off hydraulic supply in the event of a misfire. A cam follower 239 is attached to the rear end of the valve 223 and engages one of two grooves or traces 241 and 243 in the main cam 49. The normal position of the misfire detection mechanism and module shutdown valve is when the cam follower engages its forward trace 241, or the valve 223 in the forward position or open position. The valve is acted upon by several forces, depending on the control mode.

In the trigger off (bias control valve 195 in the forward position) condition, hydraulic fluid is allowed to flow into the spring chamber 235 of the misfire detection module shutdown system valve. The combination of the spring and the hydraulic pressure forces the valve to remain in the forward position with the cam follower 239 engaged in the forward cam trace 241.

In the trigger on (bias control valve 195 in the rear position) condition, hydraulic fluid flows into the rear chamber, acting on the rear piston 237 and exerting a force rearward on the valve 223. However, during normal firing, high pressure propellant gases are bled into the gas chamber 121 which exert a force to maintain the valve 223 in the forward position. The combination of the bleed gas pressure and spring exert a greater force than the hydraulic force so the valve stays in the forward direction.

In the event of a misfire, there will be no propellant gas pressures generated. The hydraulic fluid pressure in the rear chamber of the housing 209 acting on the rear piston 237 will overcome the force of the spring 235 and will exert a net rearward force. As the main cam 49 rotates around, the cam follower 239 will engage the transfer groove or path 245 and will move rearward to engage the rear groove or trace 243. The misfire detection and module shutdown valve 223 will be forced to the rear and will remain in this position. In moving to the rear position, the valve will shut off the primary hydraulic flow from the conduit 191 to the bias control valve 195, the bolt and injector control valve 247, the breech lock control valve 277 and the projectile loader control valve 279. The shutdown hydraulic circuit is opened, and hydraulic fluid will flow through the restricting orifice 233 and through the check valve 301 to the forward end of the breech lock actuator 163 and through the check valve 343 to the forward end of the projectile loader actuator 112. The breech lock actuator 163 is forced to the rear into the locked position. The projectile loader actuator 112 is also forced to the rear. Hydraulic fluid also flows through the three-way time delay valve 161 and forces the purge valve piston yoke 147 forward, opening the chamber purge valve 141 and 143. Fuel (which may be JP-4 in the case of an aircraft installation) or other fluid (such as water) from the purge supply will flow through the chamber and out to the purge sump, flushing the propellant charge out of the firing chamber 57. After a suitable time delay, the three-way valve 161 will bypass the hydraulic fluid to the return line 193, and the purge valve spring 157 will force the purge valve piston to the rear, closing the chamber purge valves.

In the misfire condition, the bolt 55 and the injector piston 65 will remain locked in the forward position, and the gun module 31 will shutdown until serviced.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

We claim:

1. A fluid powered actuator system, said system comprising an actuator motor, a source of pressurized fluid for powering the actuator motor, and a control valve operatively associated with the source of pressurized fluid and the actuator motor for producing in a first mode of operation cyclic reciprocation of the motor in response to reciprocation of the control valve and for producing in a second mode of operation retention of the motor in a fixed position in response to reciprocation of the control valve, said control valve having a valve body, a first valve spool mounted for limited reciprocation within the valve body, and a second valve spool in the form of a sleeve encircling a central portion of the first valve spool and mounted for limited reciprocation with respect to both the valve body and the first valve spool, first seal means between the outer periphery of the sleeve and the valve body, second seal means between the inner periphery of the sleeve and the central portion of the first valve spool, first and second abuttment means connected to opposite ends of the first valve spool for engaging corresponding first and second end faces of the sleeve to control the position of the sleeve and defining respective expansible control chambers therebetween when the sleeve is shifted to place an end face against a related one of the abuttment means, a first control port in the valve body for transmitting the pressurized fluid into one of said control chambers to the second end face of the sleeve to shift the sleeve to place the first end face against the first abuttment means in said first condition of operation of the control valve, a second control port in the valve body for transmitting the pressurized fluid into the other of said control chambers to the first end face of the sleeve to shift the sleeve to place the second end face against the second abuttment means in said condition of operation of the control valve, bias inlet and exhaust control valve means for directing the pressurized fluid to the first control port while opening said second control port to exhaust and effective to retain said first face in engagement with the first abuttment means during the first mode of operation and for directing the pressurized fluid to the second control port while opening said first control port to exhaust and effective to retain said second face in engagement with the second abuttment means during the second mode of operation, reciprocating means for cyclically reciprocating the first valve spool and the sleeve as a unit back and forth in the valve body in both the first mode of operation and in the second mode of operation, land and groove means on the outer periphery of the valve sleeve, and flow ports in the valve body so located with the land and groove means as to alternatively direct the pressurized fluid flow to opposite ends of the actuator motor to produce cyclical reciprocation of the motor with cyclical reciprocation of the first valve spool when said first end face is shifted against said first abuttment means during the first condition of operation and to direct pressurized fluid flow to one end only of the motor when said second end face is shifted against said second abuttment means in the second condition of operation of the control valve, whereby the control valve is effective to produce a dual mode of operation without the need to depressurize any part of the fluid-powered actuator system, to provide additional by-pass circuits, or to discontinue reciprocation of the first valve spool.

* * * * *